US010414056B2

(12) United States Patent
Lee et al.

(10) Patent No.: US 10,414,056 B2
(45) Date of Patent: Sep. 17, 2019

(54) COOKING KNIFE

(71) Applicant: Tung-Hsien Lee, Tainan (TW)

(72) Inventors: Tung-Hsien Lee, Tainan (TW); Jing-Feng Wu, Tainan (TW); Guo-Lin Huang, Tainan (TW)

(73) Assignee: Tung-Hsien Lee, Tainan (TW)

( * ) Notice: Subject to any disclaimer, the term of this patent is extended or adjusted under 35 U.S.C. 154(b) by 0 days.

(21) Appl. No.: 15/868,933

(22) Filed: Jan. 11, 2018

(65) Prior Publication Data

US 2018/0311838 A1 Nov. 1, 2018

(30) Foreign Application Priority Data

Apr. 28, 2017 (TW) ..... 106205980 U

(51) Int. Cl.

| | |
|---|---|
| ***B26B 1/10*** | (2006.01) |
| ***B26B 9/00*** | (2006.01) |
| ***B26B 29/02*** | (2006.01) |
| ***B26B 3/04*** | (2006.01) |

(52) U.S. Cl.

CPC ..... *B26B 1/10* (2013.01); *B26B 3/04* (2013.01); *B26B 9/00* (2013.01); *B26B 29/02* (2013.01); *B26B 29/025* (2013.01)

(58) Field of Classification Search

CPC .. B26B 1/10; B26B 29/02; B26B 9/00; B26B 29/025; B26B 3/04; A47J 17/02; A47J 17/00

USPC ..... 30/279.2, 279.6

See application file for complete search history.

(56) References Cited

U.S. PATENT DOCUMENTS

| | | | | |
|---|---|---|---|---|
| 660,302 | A * | 10/1900 | Lowman | |
| 2,228,572 | A * | 1/1941 | Lofgren | A47J 17/02 30/279.6 |
| 6,308,419 | B1 * | 10/2001 | Neshat | B26B 29/025 30/151 |
| 6,634,503 | B2 * | 10/2003 | Welsh, Jr. | B26B 29/025 206/349 |
| D486,703 | S * | 2/2004 | Settele | D7/695 |
| 8,893,392 | B2 * | 11/2014 | Sampaio | A47J 17/02 30/279.2 |
| 2013/0305935 | A1 * | 11/2013 | Ebrahim | A47J 17/02 99/591 |
| 2018/0311838 | A1 * | 11/2018 | Lee | B26B 3/04 |

FOREIGN PATENT DOCUMENTS

DE 10 2018 110 201 A1 * 10/2018 ..... B26B 1/10

* cited by examiner

*Primary Examiner* — Hwei-Siu C Payer

(74) *Attorney, Agent, or Firm* — Aeon Law, PLLC; Adam L. K. Philipp; Martin S. Garthwaite

(57) ABSTRACT

A cooking knife includes: a handle, a plurality of blades and a sheath. The plurality of blades is disposed on the first portion and the second portion of the handle. The sheath includes two sheath shells and a pivot shaft, the two sheath shells being pivotally connected to each other by the pivot shaft in such a manner that the two sheath shells pivotally rotate by the pivot shaft in reverse direction to get close to each other or draw away from each other.

9 Claims, 6 Drawing Sheets

COOKING KNIFE

FIELD OF THE INVENTION

The present invention relates to a cooking knife, and more particularly relates to a cooking knife with storable blades.

BACKGROUND OF THE INVENTION

A cooking knife is referred to a knife used for food preparation. There are various kinds of cooking knifes, each being with different function for different food preparation processes such as peeling, grating, slicing, grinding, etc. depending on different food materials and cooking methods. Some kinds of cooking knifes are made of material easy to be rusted so as to be blunted out quickly such that the replacing would consequently take place in high frequency. Therefore, people need to prepare additional knifes in advance for the occurrence of replacement. Nevertheless, having numerous knifes placed in the cooking place not only takes up space, but also wastes a lot of time for searching the right knife from different knifes such that the cooking is lack of efficiency.

Accordingly, there are various kinds of multi-head cooking knifes in the market. These multi-head cooking knifes can be found with blades disposed on each end of the single handle. However, with more blades disposed on the handle, the handling area where a user can hold become less so as to lead the inconvenience for operation and increase the risk of injury caused by careless touches in daily use. Besides, some multi-head cooking knifes become bulky and weighted because of too many blades installed thereon such that users cannot easily use them.

SUMMARY OF THE INVENTION

Therefore, an objective of the present invention is to provide a cooking knife with multiple blades which is easy and safe to use.

In order to achieve the above, the present invention provides a cooking knife, comprising: a handle having a first portion at one end thereof, a second portion at the other end thereof and a handle main body, the handle main body being connected between the first portion and the second portion; a plurality of blades disposed on the first portion and the second portion of the handle; and a sheath including two sheath shells and a pivot shaft, the two sheath shells being pivotally connected to each other by the pivot shaft in such a manner that the two sheath shells pivotally rotate with respect to the pivot shaft in a reverse direction to get close to each other or to draw away from each other, wherein the two sheath shells are drawn away from each other to enable one of either the first portion or the second portion of the handle to be placed between the two drawn away sheath shells such that the two sheath shells are positioned against each other to enable the other of either the first portion or the second portion of the handle to be disposed outside the two drawn away sheath shells in such a manner that the two sheath shells are firmly secured to the handle main body so as to fix the handle to the sheath.

In one embodiment of the present invention, a cooking knife is provided that the handle main body extends in a length direction to connect between the first portion and the second portion, and the length direction and the axial direction of the pivot shaft are perpendicular to each other.

In one embodiment of the present invention, a cooking knife is provided that the plurality of blades comprise four blades disposed on the first portion and the second portion of the handle, two of the four blades are oppositely disposed on a right side and a left side of the first portion, and the other two of the four blades are oppositely disposed on a right side and a left side of the second portion.

In one embodiment of the present invention, a cooking knife is provided that the handle main body is provided with a convex body laterally protruded outwards from the handle main body, the convex body being positioned in the midpoint in relation to a length of the handle main body, the two sheath shells are positioned against each other to form a fitting portion, the fitting portion has a shape to fit the convex body and is in a position corresponding to the convex body such that when the two sheath shells are firmly secured to either the first portion or the second portion of the handle, the fitting portion being provided to firmly secure to the convex body so as to firmly secure the handle to the sheath.

In one embodiment of the present invention, a cooking knife is provided that the fitting portion is a fitting notch such that when the fitting notch is secured to the convex body, the convex body exposes from the fitting notch, and a surface of the convex body has a bumpy anti-slide structure.

In one embodiment of the present invention, a cooking knife is provided that each of the two sheath shells includes a pivot shaft portion, an abutting portion and a pressing portion, the pivot shaft portion being connected to the pivot shaft, the abutting portion being provided to receive either one of the first portion and the second portion of the handle, the pressing portion and the abutting portion being connected on opposite sides of the pivot shaft portion in such a manner that when the pressing portion of the two sheath shells are abutted to each other by a pressing force, the abutting portion of the two sheath shells are drawn away from each other.

In one embodiment of the present invention, a cooking knife is provided that the handle main body is provided with two grooves, the two grooves being in symmetry by being positioned respectively at opposing two sides of the midpoint in relation to a length of the handle main body, and the two sheath shells are provided with a conforming portion, the position of the conforming portion being correspondingly fitted to the two grooves in such a manner that the conforming portion is fitted to either one of the grooves when the two sheath shells are firmly secured to the first portion of the handle, and the conforming portion is fitted to the other groove when the two sheath shells are firmly secured to the second portion of the handle so as to firmly secure the handle to the sheath.

In one embodiment of the present invention, a cooking knife is provided that the two sheath shells are provided with respectively a concave edge portion and a convex edge portion such that when the two sheath shells are positioned against each other, the concave edge portion and the convex edge portion are in a concave-convex relationship to position against with each other.

In one embodiment of the present invention, a cooking knife is provided that one of the plurality of blades is a fruit peeler.

By means of the technology used by the present invention, the cooking knife, which is provided with a plurality of blades for alternative use, is with advantage that a variety of functions are integrated in one knife to avoid using a plurality of separate knifes when cooking in such a manner that time spent on changing knifes can be saved. Moreover, when any one of blades is in use, the other blades can be hidden by the sheath so as to avoid exposing the not used blades to disturb the using of the cooking knife and to lower the risk of hand injury caused by accidentally touching the not used blades by a user. The sheath can also be served as a grip, and consequently, there is no need for extra providing an additional grip portion for the cooking knife. Therefore, the size and the weight as well of the whole knife can be reduced and can make the cooking knife easier to use. The sheath, which is able to be opened and closed itself by means of pivotally rotatable mechanism so as to release from or install on either one of the two side portions of the handle, is with a simple and uncomplicated structure which can not only allow an easy operation for users but also simplify a process for cleaning and maintenance.

DETAILED DESCRIPTION OF THE PREFERRED EMBODIMENTS

With reference to FIGS. 1 to 6, the embodiments of the present invention are described. The description is only the explanation of the preferred embodiments, and is not the limitation of the implementation of the present invention.

Figure 1:
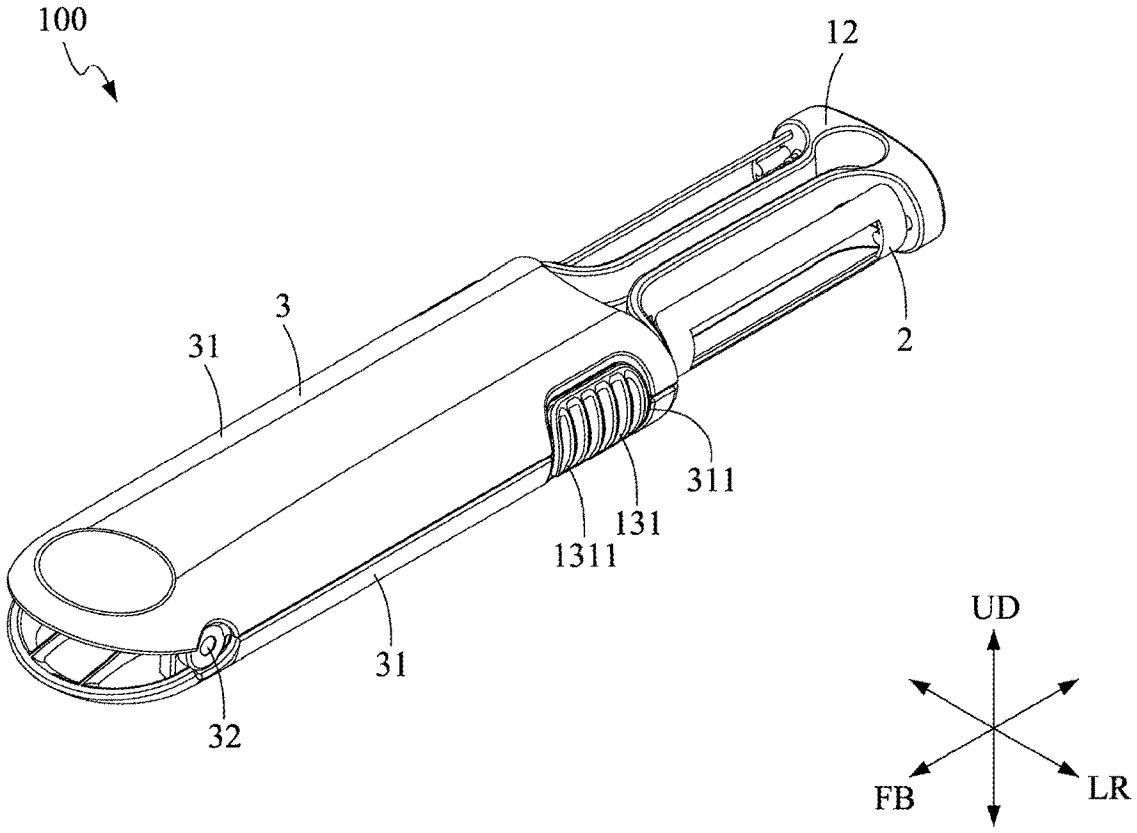
FIG. 1 is an isometric view illustrating a cooking knife according to a first embodiment of the present invention.
Figure 2:
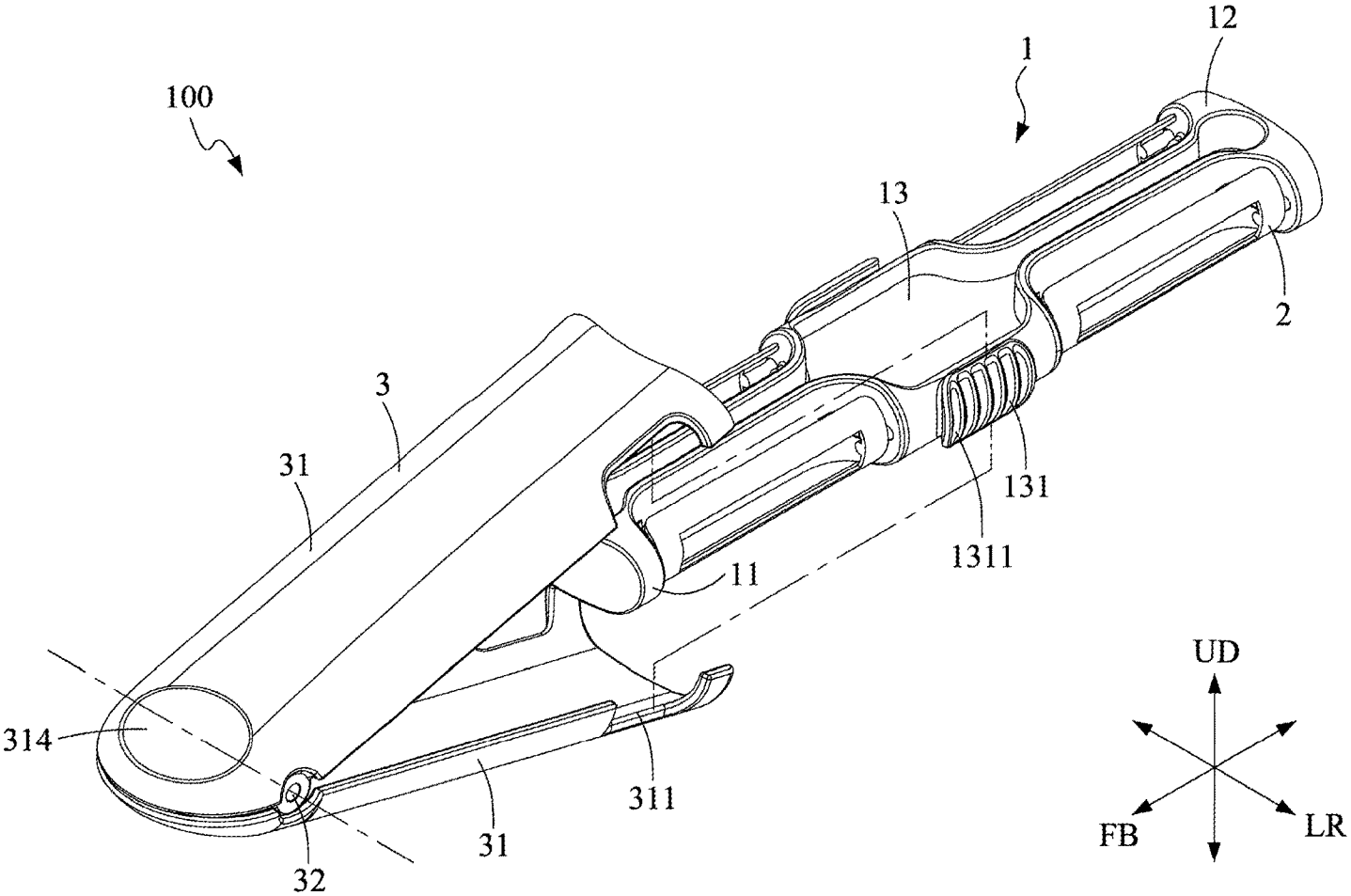
FIG. 2 is an exploded schematic view illustrating the cooking knife according to the first embodiment of the present invention.
Figure 3:
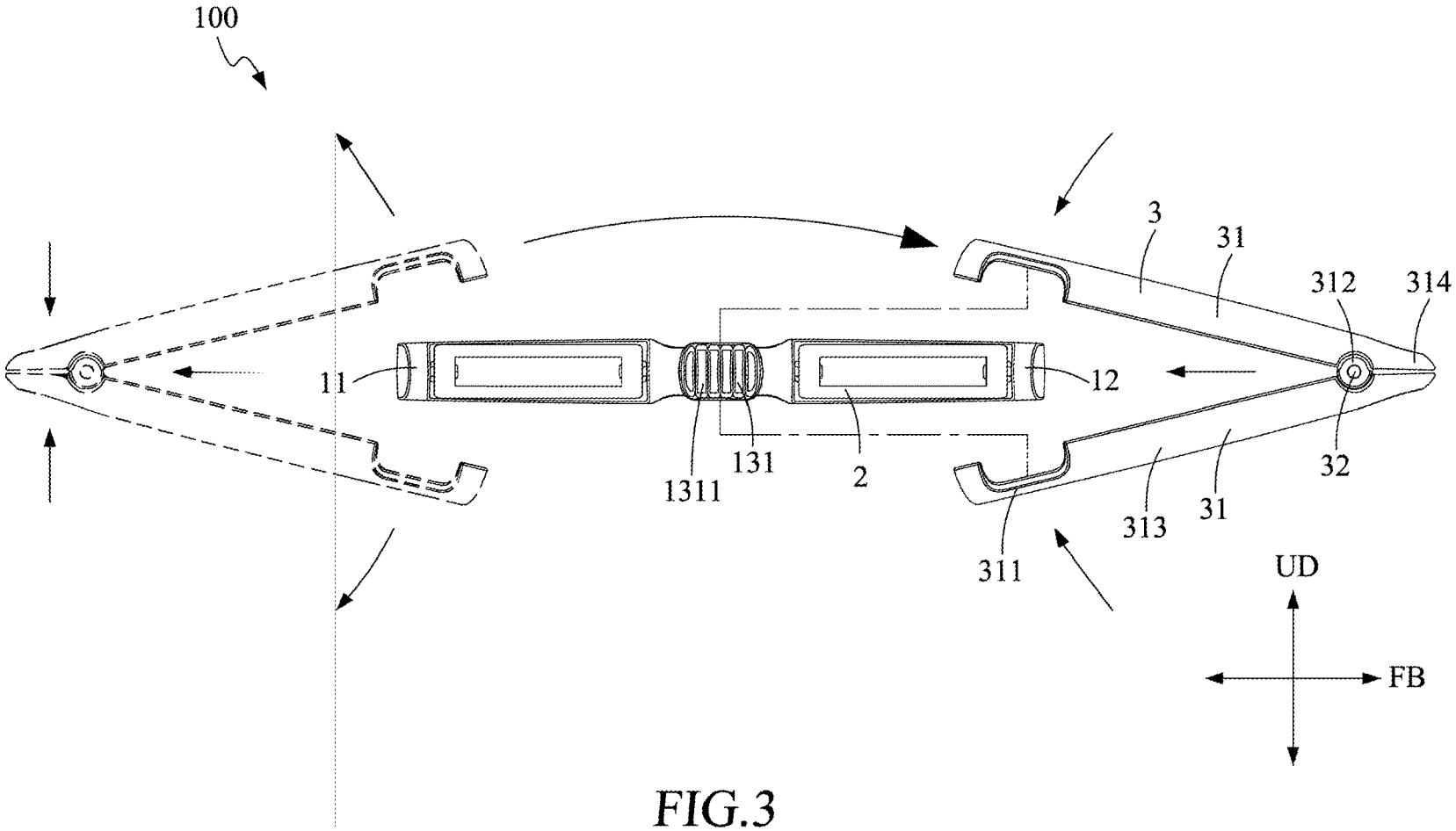
FIG. 3 is a schematic view illustrating the cooking knife according to the first embodiment of the present invention with the sheath disengaged from one portion of the handle and fixed to another portion thereof.

As shown in FIG. 1 to FIG. 3, a cooking knife 100 according to a first embodiment of the present invention includes: a handle 1, a plurality of blades 2 and a sheath 3.

The handle 1 has a first portion 11 at one end thereof, a second portion 12 at the other end thereof and a handle main body 13, the handle main body is connected between the first portion 11 and the second portion 12. In this embodiment, the shape of the handle is rectangle and in bilateral symmetry with the first portion and the second portion being provided respectively with two concave disposing portions along the left and right direction LR for disposing the plurality of blades 2.

The plurality of blades 2 disposed on the first portion 11 and the second portion 12 of the handle 1.

The size of the first portion 11 and the second portion 12 can vary such that blades 2 in other quantities, other shapes and other sizes can be disposed thereon.

In this embodiment, there are four blades for the plurality of blades 2, two of the four blades 2 are oppositely disposed on a right side and a left side of the first portion 11, and the other two of the four blades 2 are oppositely disposed on a right side and a left side of the second portion 12. Four blades 2 are disposed outwards along the left and right direction LR of the first portion 11 and the second portion 12, respectively. In order to be adapted to the needs of different uses, the four blades 2 can be different in shape and in size. The blade 2 can be fruit or vegetable peeler, grater, grinder or slicer, etc.

The sheath 3 includes two sheath shells 31 and a pivot shaft 32, the two sheath shells 31 is pivotally connected to each other by the pivot shaft 32 in such a manner that the two sheath shells 31 pivotally rotate with respect to the pivot shaft 32 in a reverse direction to get close to each other or to draw away from each other.

The two sheath shells 31 are drawn away from each other to enable one of the first portion 11 and the second portion 12 of the handle 1 to be optionally placed between the two drawn away sheath shells 31 such that when the two sheath shells 31 are positioned against each other to enable the other of the first portion 11 and the second portion 12 of the handle 1 to be disposed outside the two drawn away sheath shells 31 in such a manner that the two sheath shells 31 are firmly secured to the handle main body 13 so as to fix the handle 1 to the sheath 3 and the users can use the blades 2 on the one of the second portion 12 and the first portion11 disposed outside.

In other words, the sheath 3 can be firmly secured to either one of the first portion 11 and the second portion 12. Since when the sheath 3 is firmly secured to one portion, the blade 2 disposed on the portion is also hidden, meanwhile the sheath 3 is fixed to the handle 1 by means of the portion, the sheath 3 can be served as the grip of the handle 1 allowing the users to hold the cooking knife 100 by hand. On the other hand, the blades 2 disposed on the other portion which is not firmly secured are exposed for use. As a result, by means of changing the firmly secured position of the sheath 3, switching to the blades 2 needed for the current use between the blades 2 of the first portion 11 and the second portion 12 can easily be done, and the blades 2 which is currently not in use are covered by the sheath 3 which is served as the grip allowing for handheld usage.

In this embodiment, the handle main body 13 extends in a length direction FB to be connected between the first portion 11 and the second portion 12, and the length direction FB and the axial direction of the pivot shaft 32 are perpendicular to each other when the handle 1 is fixed to the sheath 3.

FIG. 2 and FIG. 3 show that the pivot shaft 32 is disposed along the left and right direction LR in front of the first portion 11 or behind the second portion 12 in such a manner that the two sheath shells 31 can pivotally rotate to get close to each other along the up and down direction UD of the handle 1, and thus are firmly secured to the first portion 11 or the second portion 12.

As shown in FIG. 1 and FIG. 2, in this embodiment, the handle main body 13 is provided with a convex body 131 laterally protruded outwards from the handle main body 13, the convex body 131 is positioned in the midpoint in relation to a length FB of the handle main body 13, the two sheath shells 31 are positioned against each other to form a fitting portion 311, and the fitting portion 311 has a shape to fit the convex body 131 and is in a position corresponding to the convex body 131 such that when the two sheath shells 31 are firmly secured to either the first portion 11 or the second portion 12 of the handle 1, the fitting portion 131 is firmly secured to the convex body so as to firmly secure the handle 1 to the sheath 3.

In this embodiment, the fitting portion 311 is a fitting notch such that when the fitting notch is secured to the convex body 131, the convex body 131 exposes from the fitting notch, and a surface of the convex body 131 has a bumpy anti-slide structure 1311. The exposed convex body 131 and the bumpy anti-slide structure 1311 can prevent slips.

As shown in FIG. 2 and FIG. 3, in this embodiment, each of the two sheath shells 31 includes a pivot shaft portion 312, an abutting portion 313 and a pressing portion 314, the pivot shaft portion 312 is connected to the pivot shaft 32, the abutting portion 313 is provided to receive either one of the first portion 11 and the second portion 12 of the handle 1, and the abutting portion 313 and the pressing portion 314 are connected on opposite sides of the pivot shaft portion 311 in such a manner that when the pressing portion 313 of the two sheath shells 31 abut to each other by a pressing force, the abutting portion 313 of the two sheath shells 31 are drawn away from each other making the sheath 3 to be separated from the handle 1.

In this embodiment, the pivot shaft portion 312 is a lug, being configured at the inner side of the two sheath shells 31, and one sheath shell 31 is provided with two lugs. A hole is opened on each lug allowing the pivot shaft 32 to pivotally connect the two sheath shells 31 by penetrating through the hole. The abutting portion 313 located at one side of the pivot shaft portion 312 is used to allow the sheath shells 31 to firmly secure and hide the first portion 11 or the second portion 12, and the pressing portion 314 is located at the other side of the pivot shaft portion 312 with respect to the abutting portion 313. When the two sheath shells 31 are firmly secured to the first portion 11 or the second portion 12 of the handle 1, the two pressing portions 314 and the two pivot shaft portions 312 are all located at the front side of the first portion 11 or the back side of the second portion 12. Consequently, like a lever, the pivot shaft portion 312 serving as the fulcrum, when the two pressing portions 314 abut to each other by a pressing force, the abutting portions 313 on the other side are drawn away from each other, as shown in FIG. 2 and FIG. 3.

Figure 4:
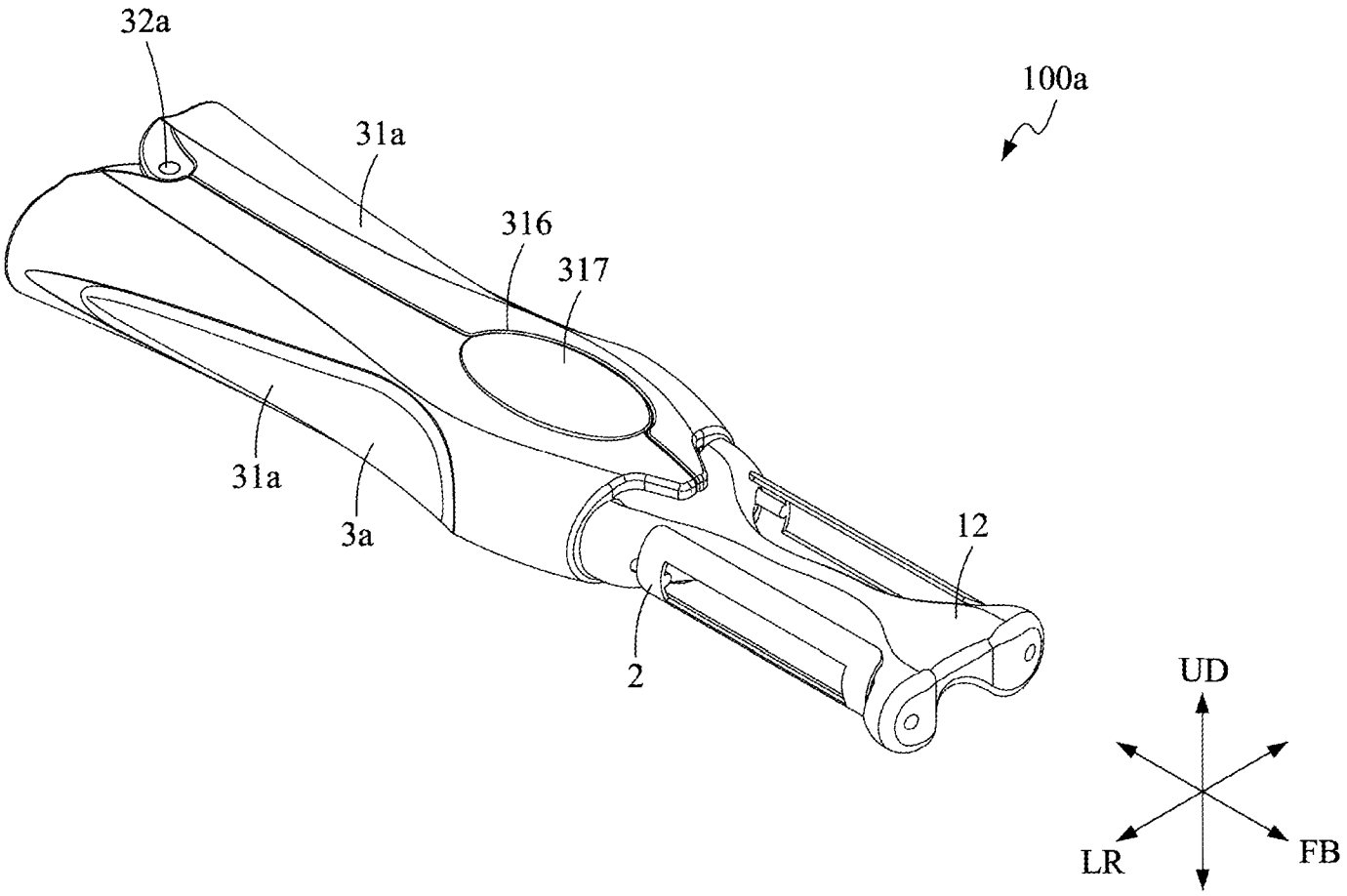
FIG. 4 is an isometric view illustrating a cooking knife according to a second embodiment of the present invention.
Figure 5:
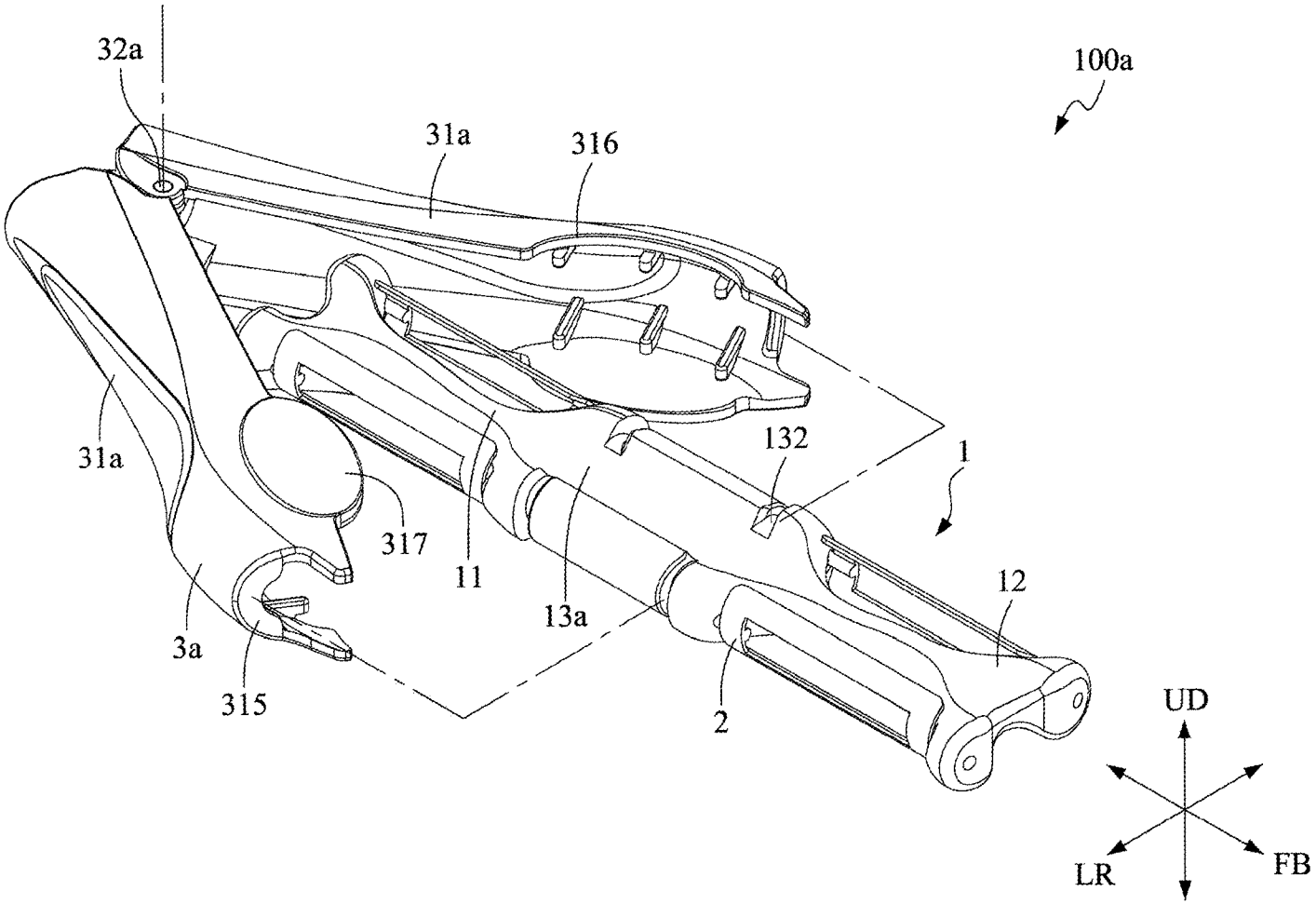
FIG. 5 is an exploded schematic view illustrating the cooking knife according to the second embodiment of the present invention.
Figure 6:
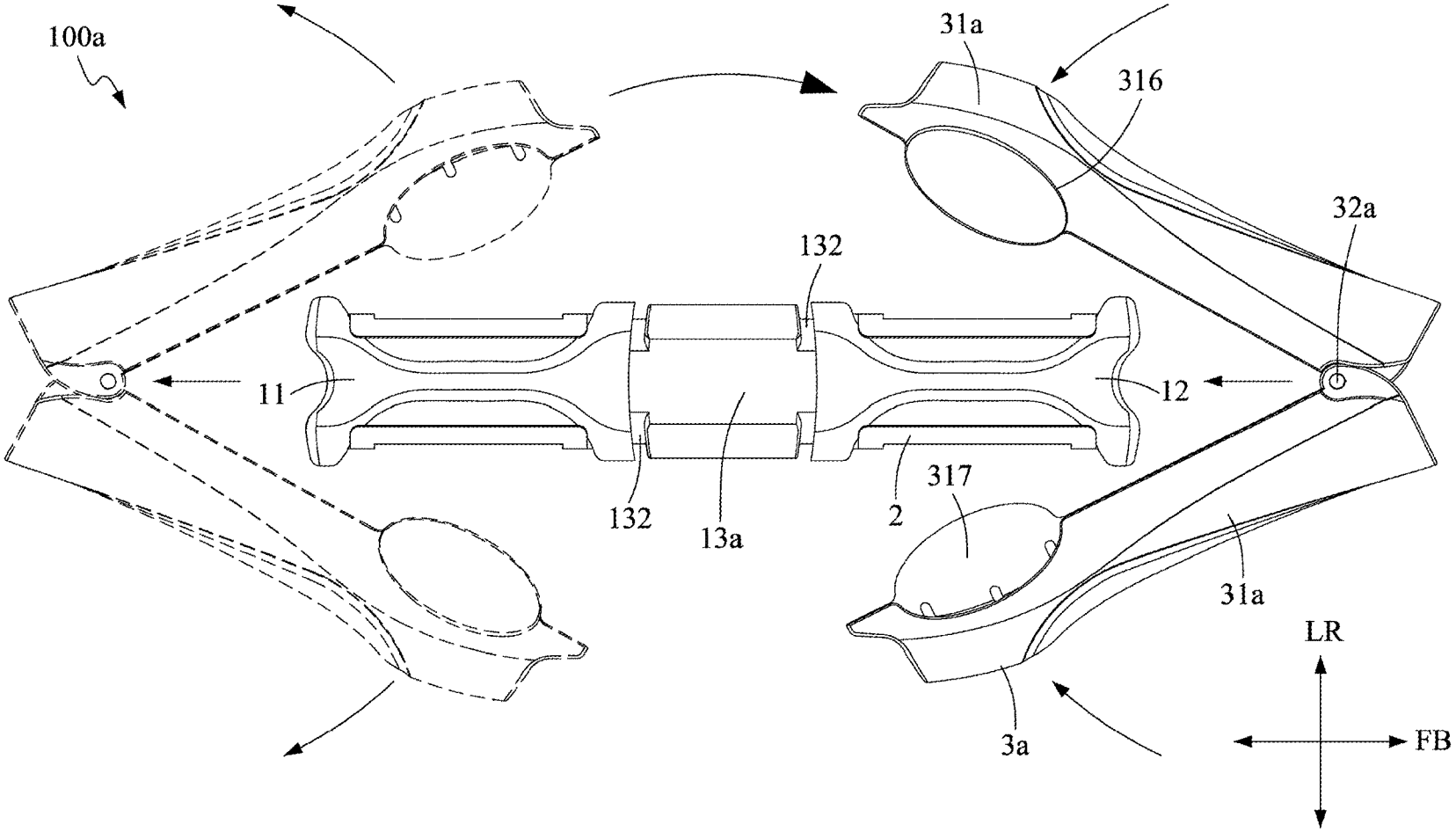
FIG. 6 is a schematic view illustrating the cooking knife according to the second embodiment of the present invention with the sheath disengaged from one portion of the handle and fixed to another portion thereof.

FIG. 4 to FIG. 6 show a cooking knife 100*a* according to a second embodiment of the present invention.

The cooking knife 100*a* has a handle main body 13*a* and a sheath 3*a* different from those of the cooking knife 100 in the first embodiment.

In this embodiment, the sheath 3*a* includes two sheath shells 31*a* and a pivot shaft 32*a*. The pivot shaft 32*a* is configured at the front side of the first portion 11 or the back side of the second portion 12 along the up and down direction UD such that the two sheath shells 31*a* can pivotally rotate to get close to each other, and thus are firmly secured to the first portion 11 or the second portion 12.

As shown in FIG. 4 and FIG. 5, in this embodiment, the handle main body 13*a* is provided with two grooves 132, the two grooves 132 are in symmetry by being positioned respectively at opposing two sides of the midpoint in relation to a length FB of the handle main body 13*a*, and the two sheath shells 31*a* are provided with a conforming portion 315, the position of the conforming portion 315 being correspondingly fitted to the two grooves 132 in such a manner that the conforming portion 315 is fitted to either one of the grooves 132 when the two sheath shells 31*a* are firmly secured to the first portion 11 of the handle 1, and the conforming portion 315 is fitted to the other groove 132 when the two sheath shells 31*a* are firmly secured to the second portion 12 of the handle 1 so as to firmly secure the handle 1 to the sheath 3*a*.

In this embodiment, as shown in FIG. 4 and FIG. 6, the two sheath shells 31*a* are provided with respectively a concave edge portion 316 and a convex edge portion 317 such that when the two sheath shells 31*a* are positioned against with each other, the concave edge portion 316 and the convex edge portion 317 are in a concave-convex relationship to position against each other. In this embodiment, the upper surface and the lower surface of the two sheath shells 31*a* are provided with respectively a concave edge portion 316 and a convex edge portion 317, and there is no limited concerning the quantity and the position of the concave edge portion 316 and the convex edge portion 317.

Moreover, the cooking knife 100, 100*a* of the present invention can include a torsion spring, the torsion spring is mounted to the pivot shaft 32, 32*a*, and the two ends of the torsion spring are attached to the two sheath shells 31, 31*a* in such a manner that the force by which the two sheath shells 31, 31*a* respectively abut the handle main body 13, 13*a* can be enhanced.

In conclusion, the cooking knife of the present invention configured with multiple blades which can be in use alternatively avoids the need to use several various knifes when grating and peeling different types of food such that time wasted on changing knife can be saved, and cleaning work can be simplified from cleaning originally multiple knifes to only one. Furthermore, the sheath of this cooking knife with the structure that opens and closes by means of pivotally rotatable mechanism makes it easy to remove and install the sheath, and also can allow the users to change as needed the portion of the cooking knife to be firmly secured as a grip while exposing the blades of the other portion for use. Moreover, the blades not in use are firmly secured in covered storage such that the security is also improved by decreasing the risk of accidentally touching the blades during food preparation. Besides, no need to be configured with an additional grip can also help to reduce weight and volume such that the operating convenience is improved.

The above description should be considered only as an explanation of the preferred embodiment of the present invention. A person with ordinary skill in the art can make various modifications to the present invention based on the scope of the claims and the above description. However, those modifications shall fall within the scope of the present invention.

What is claimed is:

1. A cooking knife, comprising:

a handle having a first portion at one end thereof, a second portion at the other end thereof and a handle main body, the handle main body being connected between the first portion and the second portion;

a plurality of blades disposed on the first portion and the second portion of the handle; and a sheath including two sheath shells and a pivot shaft, the two sheath shells being pivotally connected to each other by the pivot shaft in such a manner that the two sheath shells pivotally rotate with respect to the pivot shaft in a reverse direction to get close to each other or to draw away from each other, wherein the two sheath shells are drawn away from each other to enable one of either the first portion or the second portion of the handle to be placed between the two drawn away sheath shells such that the two sheath shells are positioned against each other to enable the other of either the first portion or the second portion of the handle to be disposed outside the two drawn away sheath shells in such a manner that the two sheath shells are firmly secured to the handle main body so as to fix the handle to the sheath.

2. The cooking knife of claim 1, wherein the handle main body extends in a length direction to connect between the first portion and the second portion, and the length direction and the axial direction of the pivot shaft are perpendicular to each other.

3. The cooking knife of claim 1 or 2, wherein the plurality of blades comprise four blades disposed on the first portion and the second portion of the handle, two of the four blades are oppositely disposed on a right side and a left side of the first portion, and the other two of the four blades are oppositely disposed on a right side and a left side of the second portion.

4. The cooking knife of claim 1 or 2, wherein the handle main body is provided with a convex body laterally protruded outwards from the handle main body, the convex body being positioned in the midpoint in relation to a length of the handle main body, the two sheath shells are positioned against each other to form a fitting portion, the fitting portion has a shape to fit the convex body and is in a position corresponding to the convex body such that when the two sheath shells are firmly secured to either the first portion or the second portion of the handle, the fitting portion being provided to firmly secure to the convex body so as to firmly secure the handle to the sheath.

5. The cooking knife of claim 4, wherein the fitting portion is a fitting notch such that when the fitting notch is secured to the convex body, the convex body exposes from the fitting notch, and a surface of the convex body has a bumpy anti-slide structure.

6. The cooking knife of claim 1 or 2, wherein each of the two sheath shells includes a pivot shaft portion, an abutting portion and a pressing portion, the pivot shaft portion being connected to the pivot shaft, the abutting portion being provided to receive either one of the first portion and the second portion of the handle, the pressing portion and the abutting portion being connected on opposite sides of the pivot shaft portion in such a manner that when the pressing portion of the two sheath shells are abutted to each other by a pressing force, the abutting portion of the two sheath shells are drawn away from each other.

7. The cooking knife of claim 1 or 2, wherein the handle main body is provided with two grooves, the two grooves being in symmetry by being positioned respectively at opposing two sides of the midpoint in relation to a length of the handle main body, and the two sheath shells are each provided with a conforming portion, the position of the conforming portion being correspondingly fitted to the two grooves in such a manner that the conforming portion is fitted to either one of the grooves when the two sheath shells are firmly secured to the first portion of the handle, and the conforming portion is fitted to the other groove when the two sheath shells are firmly secured to the second portion of the handle so as to firmly secure the handle to the sheath.

8. The cooking knife of claim 1 or 2, wherein the two sheath shells are provided with respectively a concave edge portion and a convex edge portion such that when the two sheath shells are positioned against each other, the concave edge portion and the convex edge portion are in a concave-convex relationship to position against each other.

9. The cooking knife of claim 1 or 2, wherein one of the plurality of blades is a fruit peeler.

* * * * *